US006334817B1

(12) United States Patent
Ezawa et al.

(10) Patent No.: US 6,334,817 B1
(45) Date of Patent: Jan. 1, 2002

(54) GOLF CLUB HEAD

(75) Inventors: Hiroyuki Ezawa, Fuchu; Toshiki Oonaka; Sadayoshi Furusawa, both of Shinminato; Shingo Nomura; Takashi Iihara, both of Tokyo, all of (JP)

(73) Assignee: G.P.S. Co., Ltd., Tokyo (JP)

( * ) Notice: Subject to any disclaimer, the term of this patent is extended or adjusted under 35 U.S.C. 154(b) by 0 days.

(21) Appl. No.: 09/474,400

(22) Filed: Dec. 29, 1999

(30) Foreign Application Priority Data

Nov. 4, 1999 (JP) ..... 11-313856

(51) Int. Cl.[7] ..... A63B 53/04
(52) U.S. Cl. ..... 473/324; 473/345
(58) Field of Search ..... 473/345, 346, 473/349, 350, 324, 409, 131, 290, 348

(56) References Cited

U.S. PATENT DOCUMENTS 4,314,863 A * 2/1982 McCormick
4,438,931 A * 3/1984 Motomiya
5,113,576 A * 5/1992 Van Boekel
5,176,384 A * 1/1993 Sata
5,205,560 A * 4/1993 Hoshi
5,346,217 A * 9/1994 Tsuchiya
5,397,126 A * 3/1995 Allen
5,421,577 A * 6/1995 Kobayashi
5,494,281 A * 2/1996 Chen
5,556,097 A * 9/1996 Endo
5,573,467 A * 11/1996 Chou
5,630,888 A * 5/1997 Yoshida
5,766,089 A * 6/1998 Dekura
5,871,408 A * 2/1999 Chen
5,908,356 A * 6/1999 Nagamoto

* cited by examiner

*Primary Examiner*—Sebastiano Passaniti

(57) ABSTRACT

A hollow golf club head made of a metallic material. The golf club head has a three piece structure of a main head body, face and crown. The main head body and the crown are formed by casting or press-forming, the face is formed by press-forming, and these are joined together by welding. The metallic material used is selected from a steel material group of martensite deposition hardening-type stainless steel, maraging steel, and maraging stainless steel. Only a material having a specific gravity of 7.07 or higher is used, and the head body has a volume of 280–320 cc and a weight of 180–205 g. The golf club head enables increasing the meet rate, has design freedom, exhibits excellent processability, and can be manufactured at a low cost.

11 Claims, 4 Drawing Sheets

GOLF CLUB HEAD

BACKGROUND OF THE INVENTION

1. Field of the Invention

The present invention relates to a hollow golf club head called a metal wood which is made of a metallic material.

2. Description of the Background Art

Golf clubs have achieved remarkable development as represented by enlargement of the head, extension of the shaft, and use of metallic materials with a high strength. This development effort has the target of allowing golf balls to be hit far in the right direction and increasing the meet rate, the rate at which the ball is hit by a sweet spot on the golf club.

Particularly, development of titanium alloys which are light (specific gravity: 4.5–5.0) and strong has allowed a significant increase in the head size and shaft length, enabling golf clubs to approach the above target.

However, development in this line approaches a limit. Specifically, a large moment of inertia and an increased meet rate can be achieved by a large golf club head, but enlarging the size of the golf club head increases its weight. The weight of the golf club heads currently manufactured is close to a limit. For instance, the weight allowed for a golf club with a shaft length of 45–46 inches is 190–200 g at most.

Although various titanium alloys (from 6–4 Ti to β-type Ti) are ideal metallic materials for a golf club head in terms of their strength, corrosion resistance, and processability, titanium alloys are expensive materials.

An object of the present invention is therefore to provide a golf club head which can be enlarged, can exhibit a large moment of inertia and an increased meet rate, has design freedom and excellent processability, and yet can be manufactured at a low cost.

SUMMARY OF THE INVENTION

The above object can be achieved in the present invention by a hollow golf club head made of one or more metallic materials selected from the group consisting of martensite deposition hardening-type stainless steel, maraging steel, and maraging stainless steel.

In a preferred embodiment of the present invention, the above hollow golf club head comprised a main head body formed by press-forming from a casting material or sheet material, a face part formed by press-forming or forging, and a sole or crown part formed by press-forming from a casting material or sheet material, all of which are joined by welding or brazing.

The above object can be further achieved in the present invention by a hollow golf club head made of one or more metallic materials having a specific gravity of 7.70 or more, the head having a volume of 280–320 cc and a weight of 180–205 g.

Other features, objects and advantages of the present invention will become apparent from the following description of the preferred embodiments with reference to the drawings.

DETAILED DESCRIPTION OF THE INVENTION AND PREFERRED EMBODIMENTS

Figure 1:
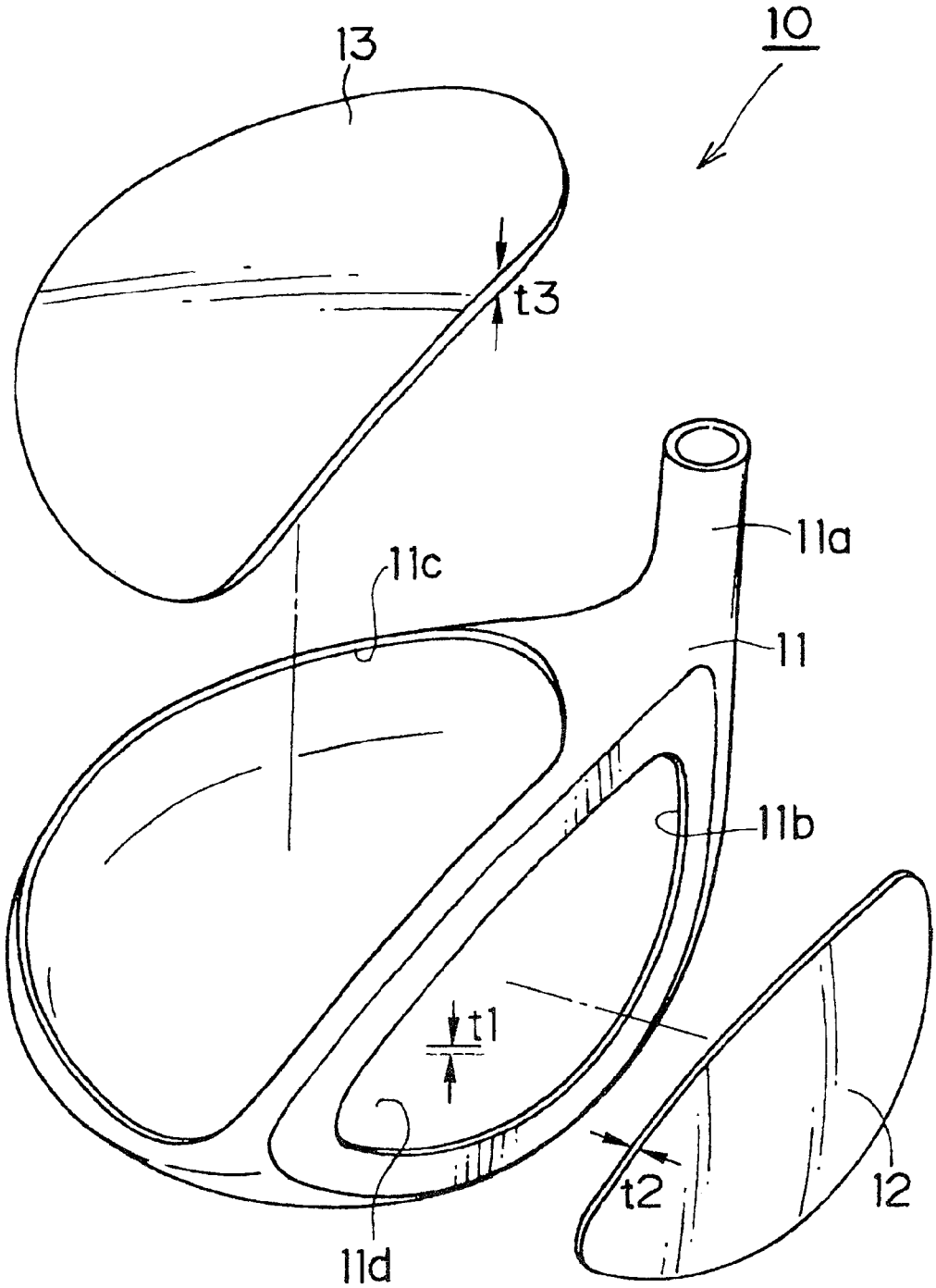
FIG. 1 is a drawing illustrating a first embodiment of the golf club head of the present invention.

The golf club head according to preferred embodiments of the present invention, is a hollow club head made of one or more metallic materials selected from the group consisting of martensite deposition hardening-type stainless steel, maraging steel, and maraging stainless steel.

As martensite deposition hardening-type stainless steel, 17-4PH (SUS630), PH13-8Mo, Almar362, Custom 455, 15-5PH, Custom 450, Custom 465, HT1770, NPH 129s, and the like can be preferably used.

As examples of maraging steel which can be preferably used, 18Ni-20, 18Ni-24, 18Ni-27, and the like can be given. AM367, NAMSA164, and the like can be given as examples of preferable maraging stainless steel.

The golf club head according to preferred embodiments of the present invention, is a hollow golf club head made of one or more metallic materials having a specific gravity of 7.70 or more, and the head has a volume of 280–320 cc and a weight of 180–205 g.

A particularly preferable volume of the finished golf club head is 300–310 cc. A particularly preferable weight of the finished golf club head is 190–200 g.

The reason for the above limitations to the volume and weight comes from the requirement for the moment of inertia, that is, the moment of inertia which ensures an improved meet rate, to be in the range from 3,000 to 4,400 $g \cdot cm^2$, and more preferably from 3,300 to 4,000 $g \cdot cm^2$.

The following examples are given as preferable structures and fabricating methods for the golf club head according to the preferred embodiments of the present invention.

A first example has a three piece structure comprising a main head body, a face, and a sole or crown. The main head body and the sole or crown are formed by press-forming from a casting material or sheet material, and a face is formed by press-forming or forging. These parts are joined by welding or brazing. This structure and method of fabrication are particularly advantageous in view of the low cost, excellent processability, and quality stability of the products.

A second example is a two piece structure comprising a main head body and a sole or crown. The main head body is formed by vacuum casting or atmospheric casting, and the sole or crown is formed by atmospheric casting. These parts are joined by welding or brazing.

In a third example, the golf club head has at least a face formed from a sheet material by press-forming or from a round bar by forging, and the face and other parts are joined by welding or brazing.

A fourth example has a four piece structure comprising a main head body, sole, crown, and neck. These parts are formed from a casting material or sheet material by press-forming and joined by welding or brazing.

In this manner, the golf club head according to the preferred embodiments of the present invention has solved problems which persons skilled in the art have deemed to be impossible to solve. Specifically, the golf club head is made of a heavy metallic material with a large specific gravity for the entire head part, and yet has a large head volume and high strength. In addition, the golf club head can be manufactured with excellent productivity and at a low cost. Needless to mention, the golf club head as fabricated has a head weight within the range in which a shaft with an appropriate length can be used.

In achieving the present invention, attention has been given to the relationship between the specific gravity of metallic materials and the meet rate of golf club heads. Specifically, among hollow golf club heads having the same volume and the same weight, those made of a metallic material having a higher specific gravity have a thinner main head body, crown, sole, etc, and yet can exhibit a larger moment of inertia. The present invention has been achieved by selecting suitable metallic materials and by developing a method of fabrication using such selected materials based on this concept.

The present invention can thus provide golf club heads satisfying the requirements in terms of both strength and weight, which conventional golf club heads manufactured by casting common stainless steel with a volume of 280 cc or more could not satisfy.

It is possible to improve the hitting direction and distance for golf balls, as well as hitting sensation and sound when golf balls are hit by the golf club head, by suitably designing the structure of the golf club head, such as a loft angle, lie angle, face progression, median angle, median distance, median depth, median height, and the like.

EXAMPLES

The present invention will be described in more detail by way of preferred embodiments with reference to the attached drawings.

First Embodiment

FIG. 1 is a drawing for illustrating a first embodiment of the golf club head of the present invention.

The golf club head 10 of the first embodiment has a three piece structure comprising of a main head body 11, a face 12, and a crown 13.

The main head body 11 has a neck 11*a* and a sole 11*d* which are integrally formed therewith, and also has a face securing opening 11*b* and a crown securing opening 11*c*.

The main head body 11 is formed from martensite deposition hardening-type stainless steel (PH13-8Mo, specific gravity: 7.9) by atmospheric casting. The thickness (t1) of the sole 11*d* is 0.7 mm in this embodiment.

The face 12 is formed from martensite deposition hardening-type stainless steel (NPH129s, specific gravity: 7.82) by cold press-forming. The face 12 has a thickness (t2) of 2.4 mm.

The crown 13 is formed from martensite deposition hardening-type stainless steel (17-4PH, specific gravity: 7.9) by casting. The crown 13 has a thickness (t3) of 0.6 mm.

t1, t2, and t3 are as-cast (A/C) thicknesses which are thicker than those in the finished product after grinding. Specifically, t1, t2, and t3 in the finished product will be less than the A/C thicknesses by about 0.1–0.2 mm, 0.2–0.3 mm, and 0.05–0.1 mm, respectively.

Then, the face 12 and the crown 13 are secured by welding respectively to the face securing opening 11*b* and the crown securing opening 11*c* of the main head body 11. As a result, the golf club head 10 of this embodiment has a volume of 305 cc and a weight of 194 g.

The reason for welding the crown 13 (not the sole) to the main head body 11 is to make the golf club head light and improve the hitting sound. Specifically, because the area of the crown 13 is smaller than the area of sole 11*d*, the weight of the welded part can be reduced.

A hitting test of 2000 golf balls using the golf club head 10 thus fabricated resulted in good metallic sounds similar to those produced by a titanium golf club head, confirming that the sound was satisfactory. The moment of inertia was measured and found to be 3750 g·cm$^2$.

This is equivalent to or better than the moment of inertia values for 400 cc or higher class club heads made of titanium alloy. There were no problems in the strength of all parts in the hitting test of the finished product.

A golf club head with a volume of 305 cc and a weight of 194 g could be fabricated according to the first embodiment using stainless alloys which are about 1.7 times heavier than titanium which is a light material having a specific gravity of 4.5. The golf club head had a sufficient moment of inertia of 3750 g·cm$^2$ and exhibited an increased meet rate. In addition, the golf club head can be manufactured at a low price because the materials are stainless steel alloys.

Second Embodiment

Figure 2:
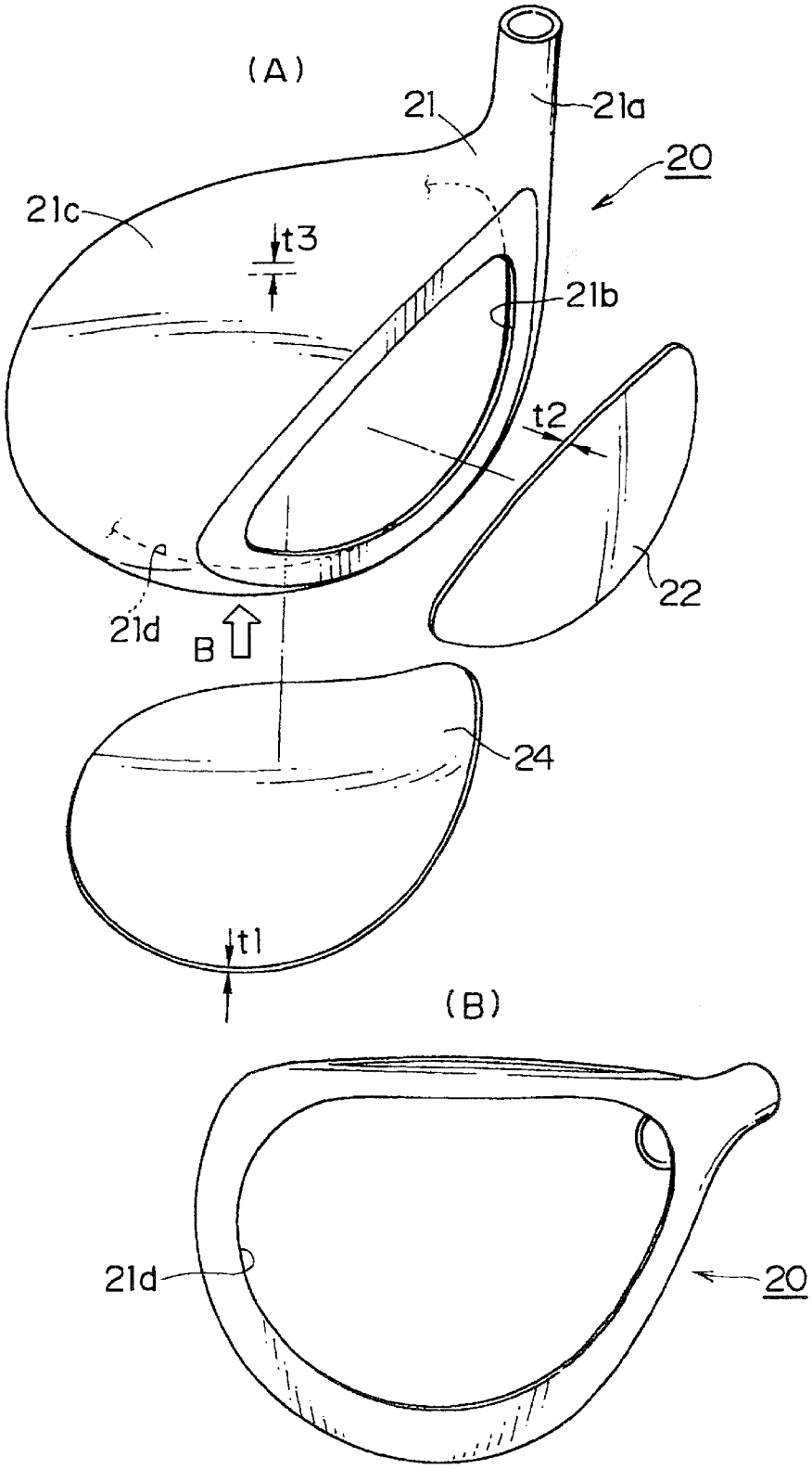
FIG. 2 is a drawing illustrating a second embodiment of the golf club head of the present invention.

FIG. 2 is a drawing for illustrating a second embodiment of the golf club head of the present invention. The golf club head 20 of the second embodiment has a three piece structure comprising a main head body 21, a face 22, and a sole 24. The main head body 21 has a neck 21*a* and crown 21*c* which are integrally formed therewith, and also has a face securing opening 21*b* and a sole securing opening 21*d*. The main head body 21 is formed from martensite deposition hardening-type stainless steel (PH13-8Mo, specific gravity: 7.9) by atmospheric casing. The crown 21*c* has a thickness (t3) of 0.7 mm.

The face 22 is formed from martensite deposition hardening-type stainless steel (NPH129s, specific gravity: 7.82) by press-forming. The face 22 has a thickness (t2) of 2.2 mm.

The sole 24 is formed from martensite deposition hardening-type stainless steel (17-4PH, specific gravity: 7.9) by a conventional casting method. The thickness (t1) of sole 24 is 0.7 mm in this embodiment.

Then, the face 22 and sole 24 are respectively secured by welding and brazing to the face securing opening 21*b* and the sole securing opening 21*d* of the main head body 21. As a result, the golf club head 20 of this embodiment has a volume of 285 cc and a weight of 188 g.

A hitting test of 2000 golf balls using the golf club head 20 thus fabricated resulted in good metallic sounds similar to those produced by a titanium golf club head, confirming that the sound was satisfactory. The moment of inertia was measured and found to be 3350 g·cm$^2$.

The golf club head of the second embodiment has an advantage of a large size and a low center of gravity. Specifically, because the sole is secured later, not only the sole thickness can be designed freely, but also the center of gravity can be adjusted by the sole.

Next, deposition hardening-type martensite stainless steel which forms the golf club heads 10 and 20 of the above-mentioned embodiments will be described in more detail. The deposition hardening-type martensite stainless steel of the type having the following characteristics can be preferably used.

(i) An alloy having the composition by weight of C=0.01% or less, N=0.01% or less, Si=0.1% or less, Mn=0.1% or less, Cr=10.0–12.5%, Ni=8.5–10.5%, Mo=1.5–2.5%, Ti=1.2–1.6%, B=0.001–0.005%, provided that C+N=0.015, with the balance being Fe and inevitable impurities, the composition satisfying the following equation.

$$957-4930\times(C(\%)+N(\%)-23.5\times Cr(\%)-44.8\times Ni(\%)-28.7\times Mo(\%)-22.2\times Ti(\%)\geqq 120 \quad (1)$$

(ii) comprising 0.1–0.5% by weight of V, in addition to (i)

(iii) having a tensile strength of more than 1700 MPa.

(iv) The alloy having Ms point of 130° C. or higher and usable for welding.

The present inventors have conducted studies on the method for increasing strength and tenacity of 10~13Cr–7~10Ni deposition hardening-type martensite stainless steel. First, the effect of the elements C+N, Si, Mn, Cr, Ni, Mo, Ti, and V on the Ms point will be described.

Figure 3:
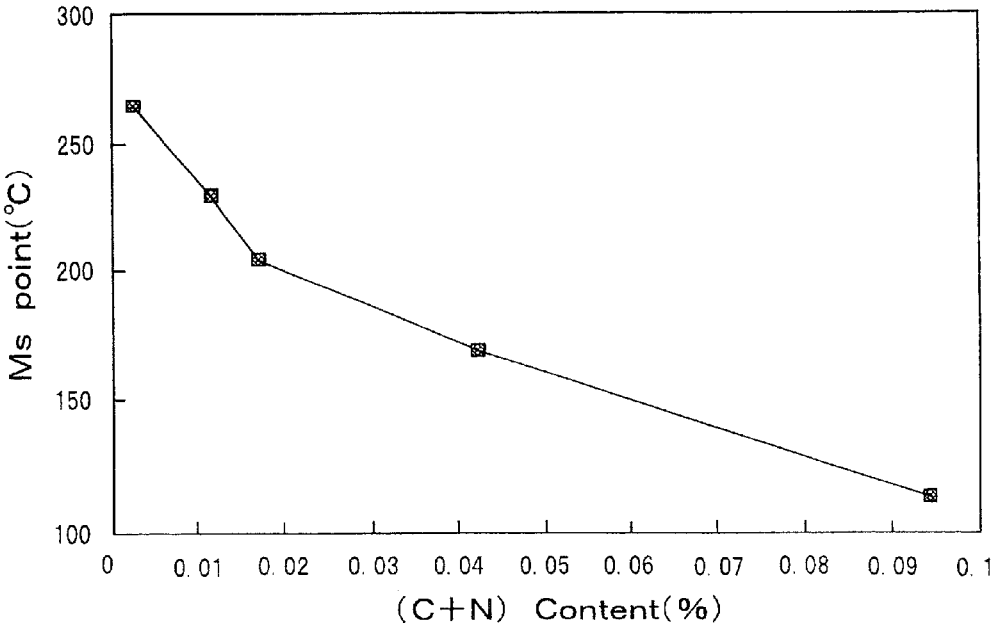
FIG. 3 is a graph showing the relationship between (C+N) and the Ms point of the deposition hardening-type martensite stainless steel.

FIG. 3 is a graph which shows the relationship between (C+N) and the Ms point. Although it is well known that C and N significantly decrease the Ms point, this effect was now found to be more remarkable in the range of (C+N) ≦0.015%.

Figure 4:
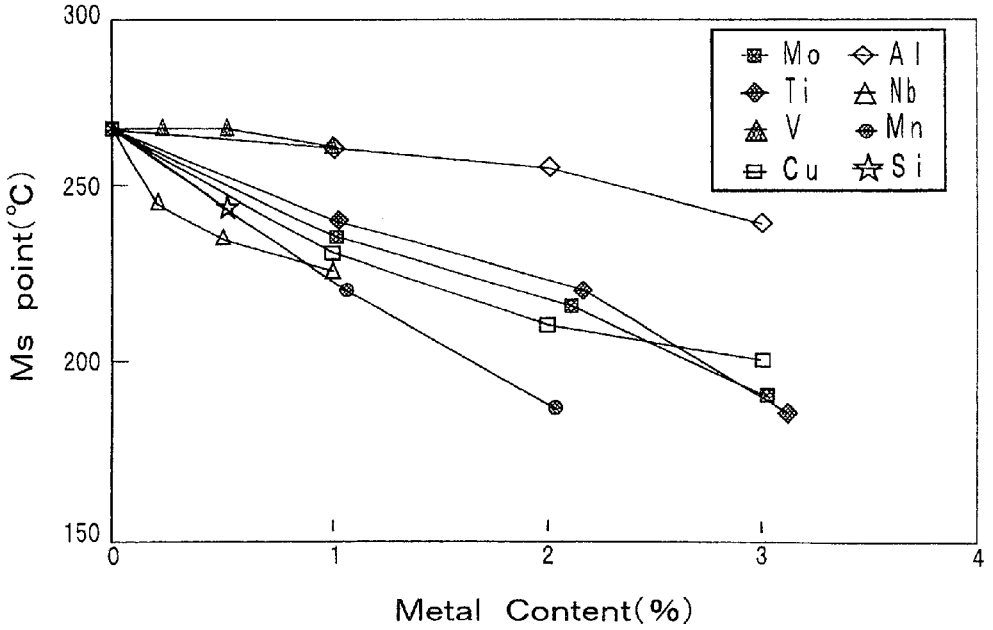
FIG. 4 is a graph showing the relationship between the amount of Si, Mn, Mo, V, Nb, and Ti and the Ms point of the deposition hardening-type martensite stainless steel.

FIG. 4 is a graph which shows the relationship between the amount of Si, Mn, Mo, V, Nb, and Ti and the Ms point. Si, Mn, Mo, and Ti have been confirmed to also decrease the Ms point of this type of alloy. Further, it was found that the addition of a small amount of Nb greatly decreases the Ms point, and V exhibits almost no effect on the Ms point.

Figure 5:
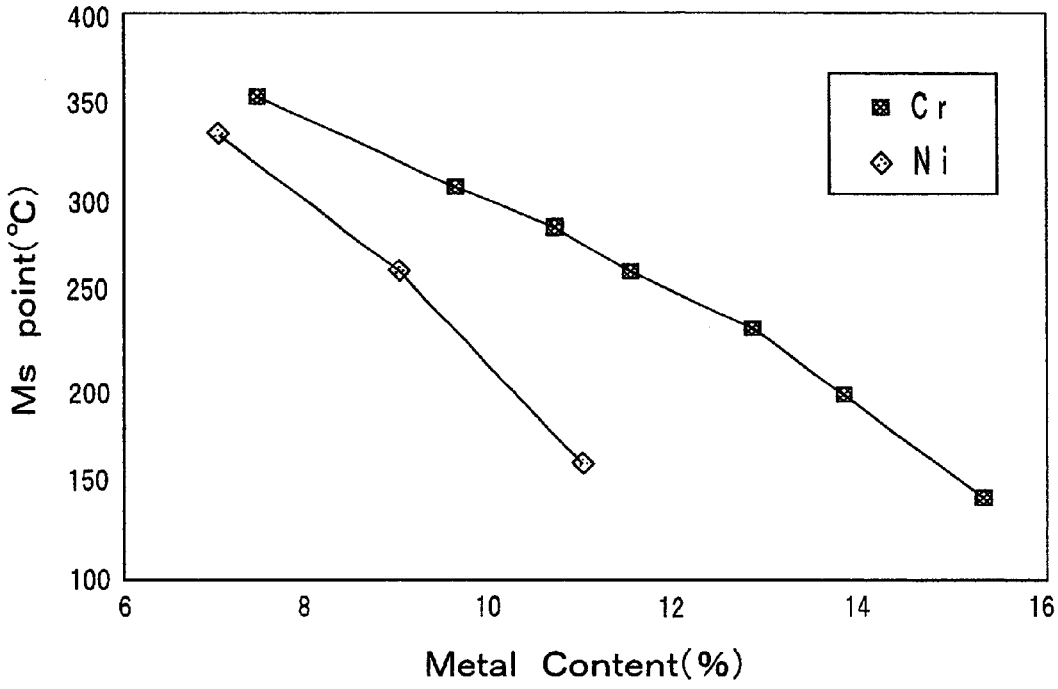
FIG. 5 is a graph showing the relationship between the amount of Cr and Ni and the Ms point of the deposition hardening-type martensite stainless steel.

FIG. 5 is a graph which shows the relationship between the amount of Cr and Ni and the Ms point. Cr and Ni have also been confirmed to decrease the Ms point of this type of alloy.

The relationship between the Ms point and martensite transformation was studied in detail based on the results of the above findings. As a result, it was found that the alloy is substantially a martensite after having been made into a solid solution, if the Ms point is 120° C. or more, and a composition system having an Ms point of 120° C. or more satisfies the above formula (1).

Furthermore, detailed studies were conducted on the effect of Ti, which is a deposition hardening element, on the hardness and tenacity. Although it is well known that the larger the amount of Ti added, the higher the strength and lower the tenacity, the tenacity was confirmed to exhibit no steep deterioration inasmuch as the ratio Ti/Ni is 0.16 or less.

As a result of the above investigation, the inventors have discovered a deposition hardening-type martensite stainless steel which exhibits a strength of 1,700 MP or higher by an aging treatment without subjecting the solid solution to a sub-zero treatment or a cold working treatment.

The reasons for the limitations to the alloy components of the preferred embodiments of the deposition hardening-type martensite stainless steel of the present invention will now be described.

C: 0.01% or Less

If the amount of C is large, the hardness of martensite increases, resulting in impaired cold working processability. Moreover, if the carbon content is large, carbide is formed, and the tenacity and corrosion resistance deteriorate. In addition, carbon content should be controlled a low amount because carbon is an element which remarkably decreases the Ms point. The carbon content should be 0.01% or less for these reasons. In addition, the formula (C+N)≦0.015% must be satisfied because nitrogen as well as carbon has the action of lowering the Ms point.

N: 0.01% or Less

If the content of nitrogen is large, nitrides which result in impaired tenacity and corrosion resistance are formed. In addition, because nitrogen is an element which remarkably decreases the Ms point, the nitrogen content should be controlled to a low amount. The nitrogen content thus should be 0.01% or less. In addition, the formula (C+N)≦0.015% must be satisfied because carbon as well as nitrogen has the action of lowering the Ms point.

Si: 0.01% or Less

Although Si is an element which strengthen a solid solution, its content should be controlled to 0.1% or less, because Si impairs tenacity.

Mn: 0.1% or Less

Mn tends to form a nonmetallic substance MnS which not only decreases tenacity, but also impairs corrosion resistance. The content of Mn thus should be controlled to 0.1% or less.

Cr: 10.0–12.5%

Cr is an indispensable element for maintaining corrosion resistance. For this reason, the addition of Cr in an amount of 10.0% or more is necessary. If too large an amount of Cr is added, on the other hand, the alloy has a decreased Ms point and contains a large amount of austenite after being made into a solid solution, which results in a lowered aging hardness. Moreover, because too large an amount of Cr produces δ ferrite and impairs tenacity, the upper limit to the content of Cr should be 12.5%.

Ni: 8.5–10.5%

Ni is an important element to provide the alloys with strength and tenacity and should be contained in an amount of at least 8.0%. If too large an amount of Ni is added, the alloy has a decreased Ms point and contains a large amount of austenite after being made into a solid solution. Therefore, the upper limit of the amount of Ni is 10%.

Mo: 1.5–2.5%

Mo is an element which is not only effective in increasing corrosion resistance, but also accelerates deposition. The effect is small if the amount added is not more than 1.5%. On the other hand, if added more than 2.5%, tenacity is impaired and δ ferrite is produced. For these reasons, the amount of Mo should be in the range from 1.5–2.5%.

V: 0.5% or less

V is an important element in accordance with the preferred embodiments of the present invention. V is an element forming carbide or nitride and exhibits the effect of immobilizing C and N in the same way as Nb. V also has an effect of making crystal particles minute. As a result of the investigation about the effect of V and Nb on the Ms point, Nb was found to decrease the Ms point, whereas V was found not to affect the Ms point. Although V is useful due to its characteristics of not affecting the Ms point and increasing the strength, the addition of too large an amount impairs tenacity. Thus, the content should be in the range from 01.0–0.5%.

Ti: 1.2–1.6%

Ti is an element which contributes to an increase of strength of steel by forming an intermetallic compound with Ni. In addition, Ti also has a great effect on disposition-hardening of the steel for the preferred embodiments of the present invention. However, because the addition of too much an amount unduly impairs the tenacity, a preferable range is from 1.2–1.6%.

B: 0.001~0.005%

B is a useful element for improving hot working characteristics. However, because too large an amount impairs processability, the preferable range is between 0.001 and 0.005%.

Steels used in the preferred embodiments of the present invention (test specimens No. 1–No. 5) and comparative steels (test specimens No. 6–No. 10) each comprising of the chemical components shown in Table 1 were melted in a vacuum melting furnace to produce steel ingots in the amount of 10 kg each. The resulting steel ingots were made into steel plates with a thickness of 5 mm by hot forging and hot rolling, followed by cold rolling to obtain test specimens with a thickness of 3.0 mm. Then heat treatment comprising of a solution heat treatment at 950° C. (water cooling at 15° C.) and an aging treatment at 500° C. was performed.

ASTM E8 test specimens were used for the tension test, and ASTM E23 2.5 mm width sub-size V-notch test specimens were used for the Charpy test.

Residual austenite, tensile strength, and Charpy impact value of the steels used in the preferred embodiment of the present invention (test specimens No. 1–No. 5) and comparative steels (test specimens No. 6–No. 10) after the aging treatment are shown in Table 2. As clear from Table 2, the preferred embodiment of the steels used in the present invention exhibit a high tensile strength and high Charpy impact value, indicating that the steels have both high strength and excellent tenacity at the same time.

In contrast, the comparative steel No. 6 exhibits only a low Charpy impact value, although its tensile strength is high. Comparative steels No. 7 and No. 8 contain residual austenite. Although these steels have a high Charpy impact value, their strength is low. The comparative steel No. 9, which contains an excess amount of Ti, exhibits high strength, but its Charpy impact value is very low. Comparative steel No. 10, which is a conventional steel, exhibits a high Charpy impact value and low strength.

The above high strength deposition hardening-type martensite stainless steel can exhibit high tenacity as well as high strength with only an aging treatment without subjecting the solid solution to a sub-zero treatment or a cold working treatment. Therefore, the golf club head with a thickness as defined in the present embodiment can provide sufficient tenacity and strength.

As described above in detail, because the golf club head according to the preferred embodiments of the present invention has a maximum moment of inertia, the meet rate in hitting can be increased and missed shots can be minimized. In addition, the golf club head according to the preferred embodiments of the present invention has design freedom, exhibits excellent processability, and can be manufactured at a low cost.

Obviously, numerous modifications and variations of the present invention are possible in light of the above teachings. It is therefore to be understood that, within the scope of the appended claims, the invention may be practiced otherwise than as specifically described herein.

What is claimed is:

1. A golf club head comprising:

a hollow structure made of martensite deposition hardening-type stainless steel having a specific gravity of 7.70 or more, and the head having a volume of 280–320 cc and a weight of 180–205 g, wherein the martensite deposition hardening-type stainless steel is an alloy having the composition by weight of C=0.01% or less, N=0.01% or less, Si=0.1% or less, Mn=0.1% or less, Cr=10.0–12.5%, Ni=8.5–10.5%, Mo=1.5–2.5%, Ti=1.2–1.6%, B=0.001–0.005%, provided that C+N=0.015, with the balance being Fe and inevitable impurities, the composition satisfying $$957-4930\times(C(\%)+N(\%))-23.5\times Cr(\%)-44.8\times Ni(\%)-28.7\times Mo(\%)-22.2\times Ti(\%)\geqq 120.$$

TABLE 1

| | Example steels | | | | | Comparative steels | | | | |
|---|---|---|---|---|---|---|---|---|---|---|
| Component | 1 | 2 | 3 | 4 | 5 | 6 | 7 | 8 | 9 | 10 PH13-8Mo |
| C | 0.004 | 0.006 | 0.005 | 0.005 | 0.009 | 0.027 | 0.004 | 0.004 | 0.005 | 0.005 |
| Si | 0.05 | 0.06 | 0.05 | 0.05 | 0.05 | 0.04 | 0.5 | 0.5 | 0.05 | 0.02 |
| Mn | 0.05 | 0.05 | 0.05 | 0.05 | 0.04 | 0.05 | 0.05 | 0.05 | 0.05 | 0.05 |
| Cr | 11.24 | 11.35 | 11.48 | 10.20 | 11.21 | 10.50 | 11.45 | 13.40 | 11.30 | 12.54 |
| Ni | 9.63 | 9.57 | 9.47 | 10.24 | 8.8 | 8.50 | 10.33 | 9.50 | 9.43 | 8.01 |
| Mo | 1.65 | 1.63 | 1.69 | 1.65 | 2.25 | 1.65 | 1.68 | 1.68 | 1.64 | 2.25 |
| V | — | 0.21 | — | — | — | — | — | — | — | — |
| Al | — | — | — | — | — | — | — | — | — | 1.20 |
| Ti | 1.32 | 1.45 | 1.58 | 1.42 | 1.46 | 1.46 | 1.48 | 1.51 | 1.75 | 0.01 |
| B | 0.0022 | 0.0025 | 0.0023 | 0.0022 | 0.0019 | 0.0023 | 0.0019 | 0.0019 | 0.0019 | — |
| N | 0.0025 | 0.0024 | 0.0034 | 0.0051 | 0.0042 | 0.0825 | 0.0029 | 0.0029 | 0.0042 | 0.0038 |

TABLE 2

| | Example steels | | | | | Comparative steels | | | | |
|---|---|---|---|---|---|---|---|---|---|---|
| | 1 | 2 | 3 | 4 | 5 | 6 | 7 | 8 | 9 | 10 |
| Ms Point (° C.) | | | | | | | | | | |
| Found | 150 | 145 | 135 | 130 | 135 | 140 | 115 | 105 | 135 | 175 |
| Formula (1) | 152 | 140 | 137 | 129 | 136 | 103 | 109 | 100 | 137 | |
| γR (%) | 0 | 0 | 0 | 0 | 0 | 0 | 4 | 8 | 0 | 0 |
| Tensile strength (Mpa) | 1710 | 1740 | 1810 | 1730 | 1790 | 1720 | 1650 | 1580 | 1870 | 1590 |
| Charpy impact value | 55 | 52 | 42 | 62 | 47 | 28 | 55 | 60 | 12 | 58 |

2. A golf club head according to claim 1, comprising a main head body formed by press-forming from a casting material or sheet material, a face part formed by press-forming or forging, and a sole or crown part formed by press-forming from a casting material or sheet material, all of which are joined by welding or brazing.

3. The golf club head according to claim 1, wherein the martensite deposition hardening-type stainless steel further comprises 0.1–0.5% by weight of V.

4. The golf club head according to claim 3, wherein the martensite deposition hardening-type stainless steel has a tensile strength of more than 1700 MPa.

5. The golf club head according to claim 3, wherein the martensite deposition hardening-type stainless steel is an alloy having Ms point of 130° C. or higher and usable for welding.

6. The golf club head according to claim 1, wherein the martensite deposition hardening-type stainless steel has a tensile strength of more than 1700 MPa.

7. The golf club head according to claim 1, wherein the martensite deposition hardening-type stainless steel is an alloy having Ms point of 130° C. or higher and usable for welding.

8. The golf club head according to claim 1, wherein the head has a moment of inertia in the range from 3,000–4,400 $g \cdot cm^2$.

9. The golf club head according to claim 1, comprising a main head body formed by vacuum casting or atmospheric casting, and a sole or crown part formed by atmospheric casting.

10. The golf club head according to claim 1, comprising at least a face part formed by press-forming from a sheet material or by forging from a bar, and the face part is joined to other parts of the head by welding or brazing.

11. The golf club head according to claim 1, comprising a main head body, sole, crown, and neck formed by press-forming from a casting material or sheet material and joined by welding or brazing.

* * * * *